US010577557B2

(12) United States Patent
Greaves et al.

(10) Patent No.: US 10,577,557 B2
(45) Date of Patent: Mar. 3, 2020

(54) FLUID WITH POLYALKYLENE GLYCOL AND UNSATURATED ESTER

(71) Applicant: Dow Global Technologies LLC, Midland, MI (US)

(72) Inventors: Martin R. Greaves, Baar (CH); Evelyn A. Zaugg-Hoozemans, Richterswil (CH)

(73) Assignee: Dow Global Technologies LLC, Midland, MI (US)

( * ) Notice: Subject to any disclaimer, the term of this patent is extended or adjusted under 35 U.S.C. 154(b) by 0 days.

(21) Appl. No.: 15/753,448

(22) PCT Filed: Aug. 17, 2016

(86) PCT No.: PCT/US2016/047269
§ 371 (c)(1),
(2) Date: Feb. 19, 2018

(87) PCT Pub. No.: WO2017/031158
PCT Pub. Date: Feb. 23, 2017

(65) Prior Publication Data

US 2018/0245016 A1 Aug. 30, 2018

Related U.S. Application Data

(60) Provisional application No. 62/207,398, filed on Aug. 20, 2015.

(51) Int. Cl.

| | |
|---|---|
| ***C10M 169/04*** | (2006.01) |
| ***C10M 105/18*** | (2006.01) |
| ***C10M 129/72*** | (2006.01) |
| ***C10M 133/12*** | (2006.01) |
| ***C10M 135/36*** | (2006.01) |

(52) U.S. Cl.
CPC ..... *C10M 169/04* (2013.01); *C10M 105/18* (2013.01); *C10M 129/72* (2013.01); *C10M 133/12* (2013.01); *C10M 135/36* (2013.01); *C10M 2203/1025* (2013.01); *C10M 2207/0406* (2013.01); *C10M 2207/282* (2013.01); *C10M 2207/2825* (2013.01); *C10M 2207/2835* (2013.01); *C10M 2207/40* (2013.01); *C10M 2207/401* (2013.01); *C10M 2207/402* (2013.01); *C10M 2209/1055* (2013.01); *C10M 2209/1065* (2013.01); *C10M 2209/1075* (2013.01); *C10M 2215/064* (2013.01); *C10M 2219/108* (2013.01); *C10N 2230/00* (2013.01); *C10N 2230/10* (2013.01); *C10N 2230/40* (2013.01); *C10N 2230/70* (2013.01); *C10N 2240/08* (2013.01); *C10N 2240/14* (2013.01)

(58) Field of Classification Search
CPC .... C10M 2207/0406; C10M 2207/402; C10M 2215/064; C10M 2219/108; C10M 2207/282; C10N 2240/14; C10N 2230/70; C10N 2230/10; C10N 2240/08
See application file for complete search history.

(56) References Cited

U.S. PATENT DOCUMENTS

| | | | | |
|---|---|---|---|---|
| 4,302,343 | A | 11/1981 | Carswell et al. | |
| 2008/0132436 | A1 | 6/2008 | Serhman | |
| 2010/0120639 | A1 | 5/2010 | Thoen et al. | |
| 2011/0039741 | A1* | 2/2011 | Thoen | C10M 141/06 508/476 |
| 2012/0108482 | A1* | 5/2012 | Greaves | C10M 107/34 508/579 |

FOREIGN PATENT DOCUMENTS

| | | |
|---|---|---|
| WO | 2008143648 | 11/2008 |
| WO | 2012030537 | 3/2012 |

OTHER PUBLICATIONS

International Search Report & Written Opinion for related PCT Application PCT/US2016/047269, dated Nov. 22, 2016 (13 pgs).
E N O, et al., "LUBE-TECH (No. 77, p. 1) Oil Soluble Synthetic Polyalkylene Glycols: A New Type of Group V Base Oil" (Jun. 21, 2011) (4 pgs).
International Preliminary Report on Patentability for related PCT Application PCT/US2016/047269, dated Mar. 1, 2018 (8 pgs).

* cited by examiner

*Primary Examiner* — Vishal V Vasisth
(74) *Attorney, Agent, or Firm* — Brooks, Cameron & Huebsch, PLLC

(57) ABSTRACT

A fluid contains a base oil consisting of an alcohol-initiated polyalkylene glycol where polyalkylene glycol component is selected from a homopolymer of 1,2-butylene oxide and copolymer of 1,2-butylene oxide and propylene oxide; a glycerol-initiated unsaturated ester that is free of tertiary carbon atoms and quaternary carbon atoms; and an antioxidant.

5 Claims, No Drawings

FLUID WITH POLYALKYLENE GLYCOL AND UNSATURATED ESTER

This application is a National Stage Application under 35 U.S.C. § 371 of International Application Number PCT/US2016/047269, filed Aug. 17, 2016 and published as WO 2017/031158 on Feb. 23, 2017, which claims the benefit to U.S. Provisional Application 62/207,398, filed Aug. 20, 2015, the entire contents of which are incorporated herein by reference in its entirety.

BACKGROUND OF THE INVENTION

Field of the Invention

The invention relates to fluids mixtures of polyalkylene glycol and unsaturated esters.

Introduction

Industrial fluids that are fire resistant, and particularly those that have thermo-oxidative stability, are desirable for high temperature applications such as lubricants and hydraulic fluids in steel processing and power generation. It is a continuous desire and challenge to increase the fire resistance and thermo-oxidative stability of such industrial fluids. Hydrocarbon oils, which are historically used as lubricants, are generally undesirable in such applications because of their combustible nature. Water-based lubricants offer better fire resistant properties than hydrocarbon oils but tend to be unsuitable for use in high temperature applications where water can evaporate. Anhydrous lubricants are typically needed for high temperature applications.

Conventional polyalkylene glycols (PAGs) are known as lubricant base oil alternatives to hydrocarbons and water. Conventional PAGs are PAGs that are initiated using a monol, diol or triol and reacted with ethylene oxide and/or propylene oxide to form polymers which typically have molecular weights greater than 500 g/mol and up to 50,000 g/mol. Lubricant compositions using such conventional PAGs as base oils offer favorable performance benefits as hydraulic fluids and turbine oils. Yet, conventional PAGs tend to suffer from oxidative instability unless an antioxidant is present. Therefore, as antioxidant depletes from a conventional PAG based lubricant composition the oxidative stability of the lubricant suffers undesirably. Conventional PAGs also have poor oil solubility. Therefore, to use them in a system that historically has used hydrocarbon fluids the system must go through an expensive thorough flushing to avoid contaminating the conventional PAG fluid with hydrocarbon fluid.

It is desirable to have an industrial fluid that is oil soluble and that demonstrates better fire resistance than conventional PAGs.

BRIEF SUMMARY OF THE INVENTION

The present invention offers a fluid that is oil soluble and that demonstrates better fire resistance than conventional PAGs. The present invention is a result of surprisingly discovering that combining an unsaturated ester with an oil soluble PAG and antioxidant can result in an elevation in fire point for the resulting fluid relative to the fire point of the PAG alone or in combination with the antioxidant.

In a first aspect, the present invention is a fluid comprising: (a) a base oil consisting of an alcohol-initiated polyalkylene glycol where polyalkylene glycol component is selected from a homopolymer of 1,2-butylene oxide and copolymer of 1,2-butylene oxide and propylene oxide; (b) a glycerol-initiated unsaturated ester that is free of tertiary carbon atoms and quaternary carbon atoms; and (c) an antioxidant.

In a second aspect, the present invention is a method of using the fluid of the first aspect, the method comprising introducing a fluid of the first aspect into an apparatus to serve as a material selected from a group selected form hydraulic fluid, turbine fluid, and lubricant The fluid of the present invention is useful as a lubricant and/or hydraulic fluid, especially for use in high temperature and high pressure applications where aqueous lubricants are undesirable.

DETAILED DESCRIPTION OF THE INVENTION

"And/or" means "and, or alternatively". All ranges include endpoints unless otherwise stated.

Test methods refer to the most recent test method as of the priority date of this document unless a date is indicated with the test method number as a hyphenated two digit number. References to test methods contain both a reference to the testing society and the test method number. Test method organizations are referenced by one of the following abbreviations: ASTM refers to ASTM International (formerly known as American Society for Testing and Materials); EN refers to European Norm; DIN refers to Deutsches Institut für Normung; and ISO refers to International Organization for Standards.

Determine kinematic viscosity according to ASTM D7042. Calculate viscosity index for a lubricant formulation according to ASTM D2270. Determine pour point according to ASTM D97. Measure hydroxyl number according to ASTM D4274. Determine fire point values according to ASTM method D92. "Molecular weight" refers to weight-average molecular weight as determined by size exclusion chromatography unless otherwise stated The present invention is a fluid comprising a base oil, and unsaturated ester and an antioxidant. The fluid is desirable as a hydraulic fluid and/or lubricant fluid. The fluid is particularly desirable due to its flame retardancy.

The base oil is a an alcohol-initiated polyalkylene glycol. Alcohol initiated means the polyalkylene glycol (PAG) was synthesized by adding alkoxides to an alcohol under catalytic conditions and growing the polymer to a target molecular weight or viscosity. The polymer grows as an initial alkoxide reacts with a hydroxyl group of the alcohol to start the polymerization process, after which alkoxides polymerize onto one another growing from the initial alkoxide. The backbone of the base oil contains a carbon atom bound to an oxygen atom and the oxygen atom is further bound to a polyoxyalkylene chain. The carbon of the backbone that is bound to the oxygen is desirably further bound only to elements selected from carbon and hydrogen. The alcohol initiator can have one, two or three hydroxyl groups on a carbon chain. Hence, the resulting base oil can have a carbon chain backbone with one, two or three oxygen atoms each having a polyoxyalkylene chain bound to the oxygen. Suitable initiators include alcohols having three or more, preferably four or more, and can contain six or more, eight or more, nine or more, 10 or more, 11 or more, even 12 or more and generally 20 or fewer carbon atoms. The number of carbons in in the initiator is evident in a PAG by the number of carbons in the backbone of the PAG. The backbone is a carbon chain from which polyoxyalkylene groups extend via an oxygen atom. Examples of suitable initiators include butanol, pentanol, hexanol, cylcohexanol, heptanol, octanol, 2-ethylhexanol, nonanol, decanol, dodecanol, stearyl alcohol, oleyl alcohol, 1,4-butanediol, neo-pentylglycol, 1,6-hexylene glycol, glycerol and trimethylopropane.

The polyoxyalkylene component of the alcohol-initiated PAG is selected from a homopolymer of 1,2-butylene oxide and a copolymer of 1,2-butylene oxide and propylene oxide. The propylene oxide is desirably 1,2-propylene oxide. The fluid is desirably free of homopolymers and/or copolymers of ethylene oxide in order to maximize the oil solubility of the base oil. Desirably, the fluid of the present invention contains less than 10 wt %, preferably 5 wt % or less and most desirably is free of polyoxyethylene and/or polyoxyethylene copolymer, where wt % is relative to total fluid weight, in order to maximize the oil solubility of the fluid.

An example of desirable alcohol-initiated PAG includes dodecanol-initiated copolymer of propylene oxide and 1,2-butylene oxide. Another example of a desirably alcohol-initiated PAG includes butanol-initiated homopolymer of 1,2-butylene oxide, also known as polybutylene glycol mono-butyl ether.

The alcohol-initiated PAG can be capped or non-capped. A "non-capped" PAG has hydroxyl (—OH) groups terminating polyoxyalkylene chains in the molecule. In contrast, "capped" PAGs have —OR functionalities instead of —OH functionalities terminating the polyoxyalkylene chains of the molecule, where the R in —OR refers to a carbon-containing group including alkyl groups, aryl groups and carbonyl groups such as those based on esters or amides.

The requirements for the initiator and PAG components of the alcohol-initiated PAG cause it to be oil soluble. A PAG is deemed "oil soluble" if they form a clear and homogeneous solution upon visual inspection when 25 grams of the PAG is mixed with 75 grams of a 20-50 carbon hydrotreated base oil having a relative density according to ASTM D-4052 of 0.84 at 15° C., and a kinematic viscosity according to ASTM D-445 of approximately 48 centiStokes (cSt) at 40° C. (NEXBASE™ 3080; NEXBASE is a trademark of Nester Oil OYJ Corporation) and stirred for 15 minutes at 23 degrees Celsius (° C.). It has been discovered that PAGs that are not oil soluble do not demonstrate the surprising increase in fire point discovered for the fluid of the present invention.

When the alcohol-initiated PAG is a copolymer of propylene oxide (PO) and 1,2-butylene oxide (BO) the ratio of PO to BO is desirably in a range of 1:1 to 1:3 by weight. In addition, or alternatively, the number average molecular weight of the alcohol-initiated PAG is desirably 2000 grams per mole or less and at the same time is desirably 500 grams per mole or more.

The alcohol-initiated PAG is desirably present in the fluid at a concentration of 70 weight-percent (wt %) or more, preferably 75 wt % or more and can be present at a concentration of 80 wt % or more, 85 wt % or more, 90 wt % or more and even 95 wt % or more based on total fluid weight.

The unsaturated ester is a glycerol-initiated unsaturated ester. A "glycerol-initiated" unsaturated ester is characterized by the ester having a carbon backbone with three adjacent carbons, each bound to an oxygen which is further bound to an acid fraction chain to form an ester branch from the carbon backbone. The unsaturated ester can be, for example, a triglyceride ester or a synthetic ester. Typical acid fractions are oleic acid, linoleic acid, linolenic acid and ricinoleic acid.

The unsaturated ester is free of esters having at least one carbon atom chosen from a group consisting of tertiary carbon atoms and quaternary carbon atoms. As such, the unsaturated ester is classified as being non-sterically hindered. Notably, there may be small levels of materials in the fluid that do have tertiary carbon atoms and/or quaternary carbon atoms but the triglyceride ester is free of such carbon atoms. For example, chlorophyll can be present in small quantities in vegetable oil but the triglycerides of the vegetable oil are free of tertiary carbon atoms and quaternary carbon atoms.

The unsaturated ester contains one or more than one carbon-carbon double or triple bond in its structure. Surprisingly, unsaturated esters but not saturated esters have been found to be effective at increasing the fire point of an alcohol-initiated PAG when included with a PAG in a fluid composition. Saturated esters lack a carbon-carbon double or triple bond.

Examples of particularly desirable unsaturated esters include high oleic sunflower oil (HOSO) and castor oil. HOSO is a triglyceride that contains approximately 85 wt % oleic acid in the acid fraction of the triglyceride structure.

The unsaturated ester is desirably present in the fluid at a concentration of five weight-percent (wt %) or more, preferably 10 wt % or more and can be 15 wt % or more while at the same time is generally 30 wt % or less, preferably 25 wt % or less and can be 20 wt % or less based on total weight of the fluid.

The fluid further comprises an antioxidant. The antioxidant is desirably a nitrogen-containing compound. Particularly desirable antioxidants include those selected from a group consisting of phenothiazine, p,p'-dioctyldiphenylamine and octylated/butylated diphenyl amine Antioxidant is generally present in the fluid at a concentration of 0.25 wt % or more, preferably 0.5 wt % or more and can be one wt % or more even 1.5 wt % or more while at the same time is generally three wt % or less, preferably 2.5 wt % or less, more preferably two wt % or less with wt % relative to total fluid weight.

A particularly desirably antioxidant for use in the fluid is phenothiazine.

The fluid can contain or be free of any one or any combination of more than one additive including those selected from a group consisting of antiwear, extreme pressure, corrosion inhibitors, yellow metal passivators, dyes and foam control additives.

It has surprisingly been discovered that the combination of base oil, unsaturated ester and antioxidant as described for the present inventive fluid has an unexpectedly high fire point which makes the fluid particularly valuable for use where flame retardancy is important. In particular, the fluid is useful as a hydraulic fluid, turbine fluid and/or lubricant.

The present invention includes a method of using the fluid of the present invention, the method comprising introducing the fluid into an apparatus to serve as a material selected from a group selected form hydraulic fluid, turbine fluid, and lubricant.

EXAMPLES

Blending Procedure.

Prepare 200 grams of each Comparative Example (Comp Ex) and Example (Ex) by adding components in the ratios specified in the tables below to a 500 milliliter glass beaker and stir under mild heat (50° C. maximum temperature).

Oil Solubility Measurement.

Add 25 grams of fluid to 75 grams of a hydrocarbon oil (NEXBASE™ 3080) and stir at room temperature for 15 minutes. Mixtures that are clear and homogeneous are "Soluble" or "S". Mixtures that are not clear and/or not homogeneous are "Not Soluble" or "NS".

Fire Point Measurements.

Determine fire point temperatures for fluids according to ASTM D92.

Table 1 identifies materials used in the Examples and Comparative Examples.

TABLE 1

| Component | Description |
|---|---|
| OSP-46 | Dodecanol initiated random copolymer (PO/BO, 50/50 by wt) with a typical kinematic viscosity at 40° C. of 46 $mm^2/s$ (cSt). Its average molecular weight is 1000 g/mole and viscosity index is 164. For example, PAG available under tradename UCON ™ OSP-46. UCON is a trademark of Union Carbide Corporation. |
| OSP-68 | Dodecanol initiated random copolymer (PO/BO, 50/50 by wt) with a typical kinematic viscosity at 40° C. of 68 $mm^2/s$ (cSt). Its average molecular weight is 1300 g/mole and viscosity index is 171. For example, PAG available under tradename UCON ™ OSP-68 |
| OA-60 | Butanol initiated homo-polymer of 1,2-butylene oxide with a typical kinematic viscosity at 100° C. of 9 $mm^2/s$ (cSt). It has an average number average molecular weight of 1000 grams per mole and viscosity index of 143. For example, the material sold under the tradename SYNALOX ™ OA-60. SYNALOX is a trademark of The Dow Chemical Company. |
| HOSO | A high oleic sunflower oil that contains approximately 85 wt % oleic acid in the acid fraction of the triglyceride structure. For example, the material sold under the tradename NATREON ™. NATREON is a trademark of The Dow Chemical Company. |
| Castor Oil | Castor oil that contains approximately 90 wt % ricinoleic acid in the acid fraction of the triglyceride structure and had a typical absolute viscosity at 25° C. of 10000 centipoise. |
| 100-30B | Polypropylene glycol monobutyl ether with a typical kinematic viscosity at 40° C. of 50 $mm^2/s$ (cSt). Its average molecular weight is 1000 g/mole and viscosity index is 190. For example, the product available under the tradename SYNALOX ™ 100-30B. |
| APPG-800R | Polypropylene glycol monoallyl ether having an allylic content of 3.5 wt %, a hydroxyl number of 70 (or 2.1 wt % OH) and an average number average molecular weight of 800 grams per mole. For example, the material sold under the tradename UCON ™ APPG-800R. |
| ADT | Saturated diester of adipic acid and reaction product of a branched alcohol with adipic acid. Has a typical kinematic viscosity at 40° C. of 27 cSt, 100° C. of 5.3 cSt, viscosity index of 136 and pour point of −54° C. and iodine number of 2 grams iodine per 10 grams according to ISO 3961. For example, the material sold under the tradename NYCOBASE ™ ADT. NYCOBASE is a trademark of Nyco S.A. Corporation. |
| 8311 | Trimethylolpropane (TMP) saturated ester derived from linear fatty acids with a typical kinematic viscosity at 40° C. of 22 cSt and 100° C. of 5.7 cSt, a viscosity index of 148, pour point of −36° C. and typical iodine number of 2 grams iodine per 100 grams using ISO3961. For example, the material sold under the tradename NYCOBASE ™ 8311. |
| NPG-05 | Neo-pentylglycol dioleate (unsaturated ester) with a typical kinematic viscosity at 40° C. of 23 cSt and 100° C. of 6.0 cSt, a viscosity index of 199, a pour point of −30° C. and a typical iodine number of 84 grams iodine per 100 grams using ISO3961. For example, the material sold under the tradename SYNATIVE ™ NPG-05. SYNATIVE is a trademark of Cognis Deutschland GmbH. |
| NPG-05/320 | Trimethylolpropanes (TMP) unsaturated ester with a typical kinematic viscosity at 40° C. of 330 cSt and 100° C. of 42 cSt, a viscosity index of 176, a pour point of −20° C. and a typical iodine number of 890 grams iodine per 100 grams using ISO3961. For example, the material sold under the tradename SYNATIVE ™ NPG-05/320. |
| NP-451 | Pentaerythritol saturated ester derived from linear C5-C10 acids with a typical kinematic viscosity at 40° C. of 25 cSt and at 100° C. of 5.0 cSt, a viscosity index of 130 and a pour point of −60° C. and a typical iodine number of 2 grams iodine per 100 grams per ISO3961. For example, the material available under the tradename ESTEREX ™ NP-451. ESTEREX is a trademark of Exxon Mobil Corporation. |
| 2336N | Trimethylolpropane trioleate unsaturated ester with a typical kinematic viscosity at 40° C. of 46 cSt and 100° C. of 9.3 cSt, a viscosity index of 191, a pour point of −36° C. and a typical iodine number of 86 grams iodine per 100 grams using ISO3961. For example, the material available under the tradename ILCO ™ lube 2336N, ILCO is a trademark of ILCO Chemikalien |
| 3080 | An American Petroleum Institute Group III hydrocarbon base oil having a typical kinematic viscosity of 46 cSt at 40° C. and 8 cSt at 100° C., a viscosity index of 130 and a pour point of −12° C. |
| Antioxidant 1 | phenothiazine |
| Antioxidant 2 | p,p'-dioctyldiphenylamine. Commercially available under the tradename VANLUBE ™ 81. VANLUBE is a trademark of R. T. Vanderbilt Company. |
| Antioxidant 3 | Octylated/butylated diphenylamine. Commercially available under the tradename IRGANOX ™ L57. IRGANOX is a trademark of BASF SE Company. |

Comparative Examples A-F: Polypropylene Glycol Mono-Butyl Ether Base Oil

Prepare fluids shown in Table 2 and characterize by Fire point determination and Oil Solubility. Fluid compositions are reported in weight-percent of each component relative to total weight of the fluid. Comp Ex A is just the base oil. Comp Ex B and C are base oil with antioxidants. Comp Exs D-F are combinations of base oil, antioxidant and esters.

Results show that none of the fluids are oil soluble. Results also reveal that the antioxidants increased the Fire Point, but that esters did not further increase Fire Point.

TABLE 2

| | | Concentration (wt %) | | | | | |
|---|---|---|---|---|---|---|---|
| Component | Description | Comp Ex A | Comp Ex B | Comp Ex C | Comp Ex D | Comp Ex E | Comp Ex F |
| 100-30B | Base Oil | 100 | 99 | 99 | 89 | 74 | 74 |
| Antioxidant 1 | Antioxidant | 0 | 1 | 0 | 1 | 1 | 1 |
| Antioxidant 2 | Antioxidant | 0 | 0 | 1 | 0 | 0 | 0 |
| 8311 | Saturated Ester | 0 | 0 | 0 | 10 | 25 | 0 |
| HOSO | Unsaturated Ester | 0 | 0 | 0 | 0 | 0 | 25 |
| Fire Point (° C.) | | 244 | 306 | 274 | 306 | 310 | 307 |
| Oil Solubility | | NS | NS | NS | NS | NS | NS |

Comparative Examples H-S: Polypropylene Glycol Mono-Allyl Ether Base Oil

Prepare fluids shown in Tables Sand 4 and characterize by Fire point determination and Oil Solubility. Fluid compositions are reported in weight-percent of each component relative to total weight of the fluid. Comp Ex H is just the base oil. Comp Ex I-K are base oil with antioxidants. Comp Exs L-S are combinations of base oil, antioxidant and esters.

Results show that none of the fluids are oil soluble. Results also reveal that the antioxidants increased the Fire Point, but that inclusion of saturated ester did not further increase Fire Point by more than 8° C.

TABLE 3

| | | Concentration (wt %) | | | | | |
|---|---|---|---|---|---|---|---|
| Component | Description | Comp Ex H | Comp Ex I | Comp Ex J | Comp Ex K | Comp Ex L | Comp Ex M |
| APPG-800R | Base Oil | 100 | 99 | 99 | 99 | 89 | 74 |
| Antioxidant 1 | Antioxidant | 0 | 1 | 0 | 0 | 1 | 1 |
| Antioxidant 2 | Antioxidant | 0 | 0 | 1 | 0 | 0 | 0 |
| Antioxidant 3 | Antioxidant | 0 | 0 | 0 | 1 | 0 | 0 |
| 8311 | Saturated Ester | 0 | 0 | 0 | 0 | 10 | 25 |
| Fire Point (° C.) | | 267 | 305 | 283 | 287 | 301 | 302 |
| Oil Solubility | | NS | NS | NS | NS | NS | NS |

TABLE 4

| | | Concentration (wt %) | | | | | |
|---|---|---|---|---|---|---|---|
| Component | Description | Comp Ex N | Comp Ex O | Comp Ex P | Comp Ex Q | Comp Ex R | Comp Ex S |
| APPG-800R | Base Oil | 89 | 89 | 89 | 74 | 89 | 74 |
| Antioxidant 1 | Antioxidant | 1 | 1 | 1 | 1 | 1 | 1 |
| ADT | Saturated Ester | 10 | 0 | 0 | 0 | 0 | 0 |
| NP-451 | Saturated Ester | 0 | 10 | 0 | 0 | 10 | 0 |
| HOSO | Unsaturated Ester | 0 | 0 | 10 | 25 | 0 | 25 |
| Fire Point (° C.) | | 304 | 303 | 309 | 313 | 309 | 313 |
| Oil Solubility | | NS | NS | NS | NS | NS | NS |

Comparative Examples T-AA: Dodecanol Initiated PO/BO Random Copolymer Base Oil Prepare fluids shown in Tables 5 and characterize by Fire point determination and Oil Solubility. Fluid compositions are reported in weight-percent of each component relative to total weight of the fluid. Comp Ex T is just the base oil. Comp Ex U-X are base oil with antioxidants. Comp Exs Y-AA are combinations of base oil, antioxidant and saturated esters.

The fluids are oil soluble. Antioxidants increased the Fire Point, but saturated esters did not further increase Fire Point by more than a few degrees Celsius.

TABLE 5

| | | Concentration (wt %) | | | | | | | |
|---|---|---|---|---|---|---|---|---|---|
| Component | Description | Comp Ex T | Comp Ex U | Comp Ex V | Comp Ex W | Comp Ex X | Comp Ex Y | Comp Ex Z | Comp Ex AA |
| OSP-46 | Base Oil | 100 | 99 | 97 | 99 | 99 | 89 | 89 | 89 |
| Antioxidant 1 | Antioxidant | 0 | 1 | 3 | 0 | 0 | 1 | 1 | 1 |
| Antioxidant 2 | Antioxidant | 0 | 0 | 0 | 1 | 0 | 0 | 0 | 0 |
| Antioxidant 3 | Antioxidant | 0 | 0 | 0 | 0 | 1 | 0 | 0 | 0 |
| 8311 | Saturated Ester | 0 | 0 | 0 | 0 | 0 | 10 | 0 | 0 |
| ADT | Saturated Ester | 0 | 0 | 0 | 0 | 0 | 0 | 10 | 0 |
| NP451 | Saturated Ester | 0 | 0 | 0 | 0 | 0 | 0 | 0 | 10 |
| Fire Point (° C.) | | 254, 256[a] | 302, 302[a] | 297 | 283 | 286 | 306 | 308 | 305 |
| Oil Solubility | | S | S | S | S | S | S | S | S |

[a]Two values for Fire Point indicate two samples were prepared and evaluated.

Examples 1-6: Dodecanol Initiated PO/BO Random Copolymer Base Oil with Antioxidant and Unsaturated Ester Prepare fluids shown in Tables 6 and characterize by Fire point determination and Oil Solubility. Fluid compositions are reported in weight-percent of each component relative to total weight of the fluid. Examples (Exs) 1-6 are combinations of base oil, antioxidant and unsaturated esters.

Results show that the fluids are oil soluble. Results also reveal (relative to Comp Ex T, U and X) that the unsaturated ester in combination with antioxidant surprisingly increases Fire Point by 55-60° C. or more over the base oil alone and 10-24 degrees Celsius over the base oil and antioxidant alone.

TABLE 6

| | | Concentration (wt %) | | | | | |
|---|---|---|---|---|---|---|---|
| Component | Description | Ex 1 | Ex 2 | Ex 3 | Ex 4 | Ex 5 | Ex 6 |
| OSP-46 | Base Oil | 89 | 89 | 89 | 74 | 74 | 74 |
| Antioxidant 1 | Antioxidant | 1 | 1 | 1 | 1 | 0 | 0 |
| Antioxidant 3 | Antioxidant | 0 | 0 | 0 | 0 | 1 | 1 |
| 2336N | Unsaturated Ester | 10 | 0 | 0 | 0 | 0 | 0 |
| NPG-05/320 | Unsaturated Ester | 0 | 10 | 0 | 0 | 0 | 0 |
| HOSO | Unsaturated Ester | 0 | 0 | 10 | 25 | 25 | 0 |
| Castor Oil | Unsaturated Ester | 0 | 0 | 0 | 0 | 0 | 25 |
| Fire Point (° C.) | | 314 | 316 | 319 | 320 | 310 | 310 |
| Oil Solubility | | S | S | S | S | S | S |

Comp Exs BB and CC and Exs 7-9: PO/BO Copolymer Base Oil

Prepare fluids shown in Tables 7 and characterize by Fire point determination and Oil Solubility. Fluid compositions are reported in weight-percent of each component relative to total weight of the fluid.

Results show that the fluids are oil soluble. Results also reveal another PO/BO base oil with which an unsaturated ester in combination with antioxidant surprisingly increases Fire Point over the base oil and antioxidant alone.

TABLE 7

| | | Concentration (wt %) | | | | |
|---|---|---|---|---|---|---|
| Component | Description | Comp Ex BB | Comp Ex CC | Ex 7 | Ex 8 | Ex 9 |
| OSP-68 | Base Oil | 100 | 99 | 74 | 74 | 74 |
| Antioxidant 1 | Antioxidant | 0 | 1 | 1 | 1 | 1 |
| HOSO | Unsaturated Ester | 0 | 0 | 25 | 0 | 0 |
| Castor Oil | Unsaturated Ester | 0 | 0 | 0 | 25 | 0 |
| NPG-05/320 | Unsaturated Ester | 0 | 0 | 0 | 0 | 25 |
| Fire Point (° C.) | | 254 | 314 | 324 | 326 | 332 |
| Oil Solubility | | S | S | S | S | S |

Comp Exs DD and EE and Exs 10-11: /BO Homopolymer Base Oil

Prepare fluids shown in Tables 8 and characterize by Fire point determination and Oil Solubility. Fluid compositions are reported in weight-percent of each component relative to total weight of the fluid.

Results show that the fluids are oil soluble. Results also reveal BO homopolymer base oil with which an unsaturated ester in combination with antioxidant surprisingly increases Fire Point over the base oil and antioxidant alone.

TABLE 8

| | | Concentration (wt %) | | | |
|---|---|---|---|---|---|
| Component | Description | Comp Ex DD | Comp Ex EE | Ex 10 | Ex 11 |
| OA-60 | Base Oil | 100 | 99 | 74 | 74 |
| Antioxidant 1 | Antioxidant | 0 | 1 | 1 | 1 |

TABLE 8-continued

| | | Concentration (wt %) | | | |
|---|---|---|---|---|---|
| Component | Description | Comp Ex DD | Comp Ex EE | Ex 10 | Ex 11 |
| HOSO | Unsaturated Ester | 0 | 0 | 25 | 0 |
| Castor Oil | Unsaturated Ester | 0 | 0 | 0 | 25 |
| Fire Point (° C.) | | 252 | 314 | 329 | 324 |
| Oil Solubility | | S | S | S | S |

What is claimed is:

1. A fluid comprising:

(a) a base oil consisting of an alcohol-initiated polyalkylene glycol where polyalkylene glycol component is selected from a homopolymer of 1,2-butylene oxide and copolymer of 1,2-butylene oxide and propylene oxide, wherein the polyalkylene glycol base oil is present at a concentration of 70 weight-percent to 89 weight percent;

(b) a glycerol-initiated unsaturated ester that is free of tertiary carbon atoms and quaternary carbon atoms, wherein the unsaturated ester is selected from high oleic sunflower oil and castor oil and is present at a concentration of 10 weight-percent to 25 weight-percent; and (c) an antioxidant, wherein the antioxidant is a nitrogen-containing compound selected from a group consisting of phenothiazine, p,p'-dioctyldiphenylamine and octylated/butylated diphenyl amine which is present at a concentration of 0.25 weight-percent to 1.0 weight-percent, and wherein the fluid is oil soluble and has an increased Fire Point by at least 55 degrees Celsius according to ASTM D92 over the base oil alone and at least 10 degrees Celsius over the base oil and antioxidant alone.

2. The fluid of claim 1, wherein the fluid is free of polyalkylene glycols comprising polymerized ethylene oxide.

3. The fluid of claim 1, where the polyalkylene glycol is selected from butanol and dodecanol initiated polyalkylene glycol.

4. The fluid of claim 1, where the antioxidant is phenothiazine.

5. A method of using the fluid of claim 1, the method comprising introducing a fluid of any previous claim into an apparatus to serve as a material selected from a group selected form hydraulic fluid, turbine fluid, and lubricant.

* * * * *